US005772027A

United States Patent [19]

Pletz

[11] Patent Number: 5,772,027

[45] Date of Patent: Jun. 30, 1998

[54] ARRANGEMENT FOR SAFE STORAGE OF CUTLERY

[76] Inventor: Horst Pletz, Sauerbruchsrtasse 8, 21365 Adendorf, Germany

[21] Appl. No.: 645,628

[22] Filed: May 14, 1996

[30] Foreign Application Priority Data

Jul. 25, 1995 [DE] Germany ..... 295 12 707 U

[51] Int. Cl.[6] ..... B65D 85/28

[52] U.S. Cl. ..... 206/372; 206/804

[58] Field of Search ..... 206/372, 349, 206/373, 804

[56] References Cited

U.S. PATENT DOCUMENTS

| | | | |
|---|---|---|---|
| 4,466,561 | 8/1984 | Slaughter | 206/349 |
| 5,372,249 | 12/1994 | Grange | 206/349 |
| 5,433,320 | 7/1995 | Daouk | 206/804 |

FOREIGN PATENT DOCUMENTS

| | | |
|---|---|---|
| 0438969 | 7/1991 | European Pat. Off. . |
| 90174127 | 5/1992 | Germany . |
| 94175209 | 1/1995 | Germany . |

*Primary Examiner*—Paul T. Sewell
*Assistant Examiner*—Nhan T. Lam
*Attorney, Agent, or Firm*—Christie, Parker & Hale, LLP

[57] ABSTRACT

A storage device for cutlery having blades attached to handles. The storage device includes a protective container having an immobilizer positioned substantially entirely within the protective container for immobilizing the cutlery. The protective container and the immobilizer are movable relative to each other from a position securing the cutlery thereby preventing the cutlery from being removed to a working position allowing the cutlery to be removed from the protective container.

20 Claims, 9 Drawing Sheets

ARRANGEMENT FOR SAFE STORAGE OF CUTLERY

FIELD OF THE INVENTION

This invention relates generally to an arrangement for storage of cutlery, and more particularly to a protective container for safely storing knives.

BACKGROUND OF THE INVENTION

The safe storage of cutlery has long been a problem, with various attempts being made to address this problem. From the German Utility Model 90 17 412.7 U1, an arrangement for storage of knives is shown, whereby insertion shafts are provided in a block for the blades of the knives. Also provided is a pivotable clip which when moved to an end position, engages the knife handles and keeps them from falling out of the block. In a working position of this arrangement, in which the knives can be removed from the block, the clip is pivoted to a support leg position at an acute angle to the line of the insertion shafts.

This arrangement has the disadvantage that safe storage of knives, in which the ability to touch the blade edges is prevented, is possible only when the clip fits the length of the knives. If relatively small knives are stored, they can be pulled out of the block to a certain extent from the storage position such that the blade edge is exposed. Since the arrangement is free standing, unintentional touching of the knife edge can occur.

The object of the present invention is to enable safe storage of cutlery, and in particular for knives of differing lengths.

SUMMARY OF THE INVENTION

In an arrangement for storage of cutlery, and in particular for knives, a protective container in which is provided at least one movable retaining element immobilizing the blades, is provided according to the present invention. The movable retaining element and the protective container are movable relative to each other from a position protecting the cutlery to a working position. In the working position, the cutlery can be removed from and returned to the protective container.

This arrangement has the advantage that cutlery items of differing lengths can be safely stored anywhere in the protective container since they are held in place by the blade and not by the handle. In this arrangement, the cutlery can also be readily removed because of the movability of the retaining elements.

The protective container preferably has a base, two side walls, and a plurality of dividing walls. The walls run in the direction of the cutlery to be stored and have an overall width which is preferably somewhat larger than the height of the blades of the cutlery to be stored.

In one embodiment, a magnetic rod with recesses for the knife blades, disposed at a right angle to the knife blades, is provided as the movable element. The magnetic rod is movably mounted in elongated holes in the walls of the protective container. The elongated holes run preferably at least almost at right angles to the direction of the walls. When the protective container lies with its base on a supporting surface, the magnetic rod lies at the lower end of the elongated holes and the cutlery is in a protected position in the protective container. By raising the magnetic rod the cutlery is lifted to a removal position, and the blades can be removed from the magnetic rod.

In a preferred embodiment, the protective container has swing-out support legs for moving the container to an inclined position. The support legs are preferably disposed below the handles of the cutlery stored in the protective container. The support legs include a section to raise the knife handles to the inclined position of the protective container. This preferred embodiment has the additional advantage that by swinging the support legs out, the handles of the cutlery are simultaneously raised as well as the magnetic rod with the cutlery. This inclined position is thus also the working position.

In an alternative embodiment for the storage of cutlery, and in particular for knives, a protective container is provided with at least one separated storage container for the cutlery. The protective container and the storage container are movable relative to each other from a safe position in which the cutlery cannot be removed to a working position. This relative movability of the storage container and the protective container means that the storage container is movable relative to the stationarily disposed protective container and the protective container is movable relative to the stationarily disposed storage container or that both are movable. It is, however, preferable that the storage container be movable relative to the protective container which is resting on a supporting surface.

The advantage of this alternative embodiment is that the storage containers for the cutlery are not free standing but are themselves placed inside a container. If knives whose handles are so short that they can be pulled to a certain extent from the storage container, even in their safe position, there is no danger of injury from the blades since they are still inside the protective container.

In the alternative embodiment, the end of the storage container for insertion of the knives can be pivoted out of the protective container by means of a pivotable lever. Thus the storage container, in the safe position, is in a largely closed container making removal of the knives virtually impossible. Only after pivoting the storage container out of the protective container on its insertion end can the cutlery be removed from the storage container.

In one embodiment, the pivotable levers are disposed on a shaft upon which are also positioned supporting legs. The supporting legs can also be extended using the lever to raise the protective container to the inclined position. The levers can be disposed inside the protective container, whereas the supporting legs are provided on the sides outside the protective container.

Alternatively, the pivotable levers can also serve as the support legs for moving the protective container to the inclined position. In this embodiment the levers are located in an opening in the base of the protective container, whereby the supporting legs fill the opening when the storage containers are pivoted into the safe position within the protective container. In the safe position, it is impossible to reach into the protective container from the bottom.

The pivotable levers may lie loosely against the storage containers or be attached to it by a joint. In the former case, the storage containers are merely pivoted around a stationary axis of rotation. The stationary axis of rotation is preferably provided at the end of the storage container which is opposite the insertion opening of storage container. In the second case, the pivot point is the location of the axis of rotation of the storage container. In the rotation of the levers in the second case, the storage containers is both tilted and shifted in the direction opposite the insertion direction of the cutlery.

In yet another embodiment, pivotable mounting of the storage container can also be effected in the protective container by including a pivotable magnetic rod through the protective container. The magnetic rod has a semi-circular cross section, whereby the flat portion rests on the storage containers and magnetically connects the storage container to the protective container.

To immobilize the insertion end position of the protective container, stop elements are coordinated between the protective container and the pivotable levers to keep the protective container in the working position.

Additional safety of the storage container in the storage position can be effected in that a removable rod-shaped safety element is provided above the pivotable storage container and running at a right angle to it. This additional safety element is advantageous when there is a danger that small children might have contact with the protective container. This safety element can also be designed as a steel knife sharpener.

DETAILED DESCRIPTION

Figure 1:
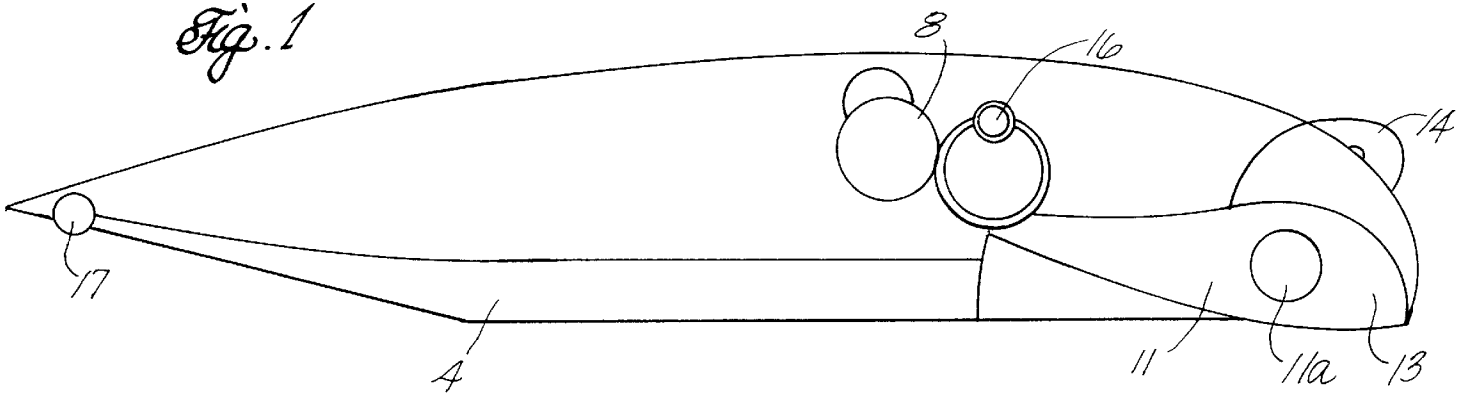
FIG. 1 is a side view of a protective container with a movable magnetic rod to immobilize knives of the present invention.
Figure 2:
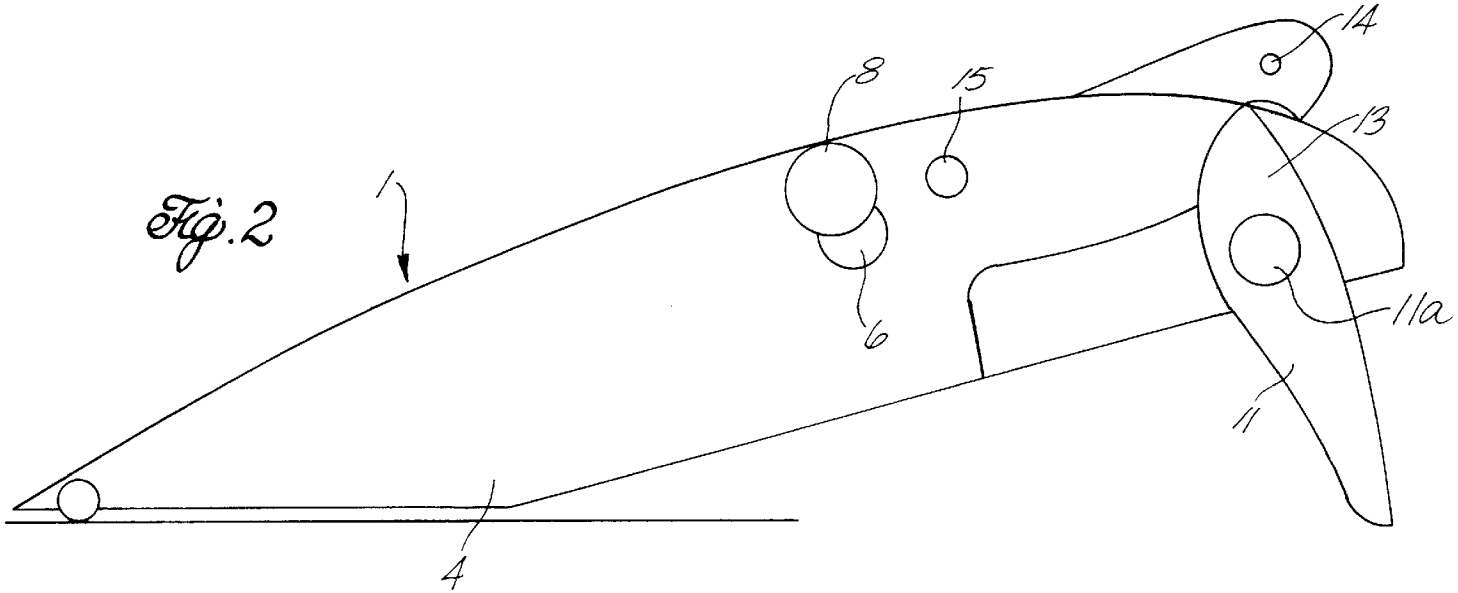
FIG. 2 is a side view of the protective container of FIG. 1 in the removal position.
Figure 3:
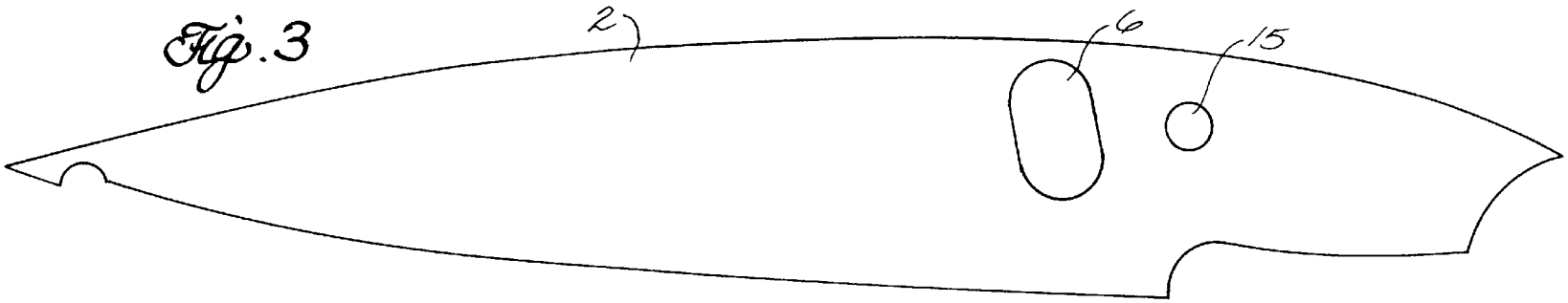
FIG. 3 is a side view of one side wall of the protective container of FIG. 1.
Figure 5:
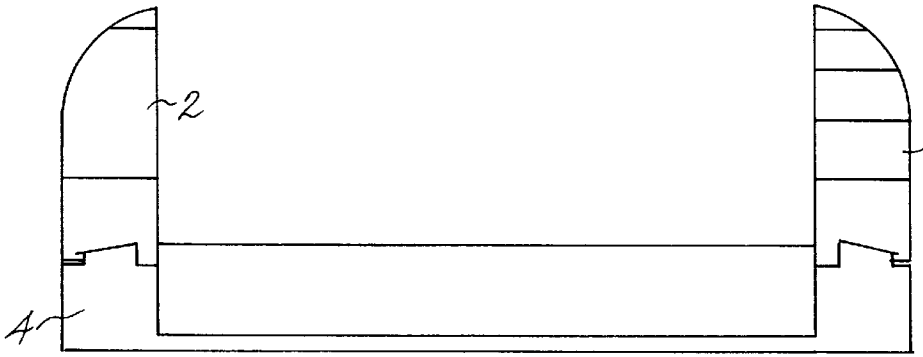
FIG. 5 is a cross-sectional view through the protective container of FIG. 1 without the magnetic rod.
Figure 4:
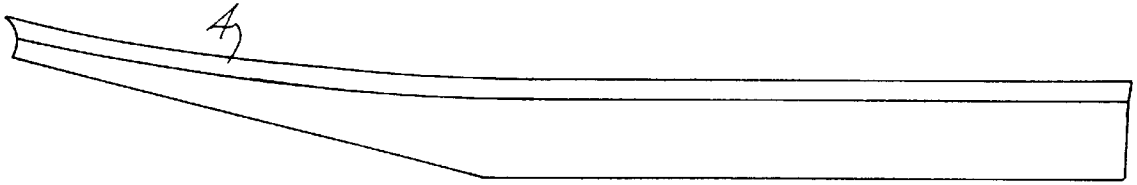
FIG. 4 is the side view of the base of the protective container of FIG. 1.
Figure 6:
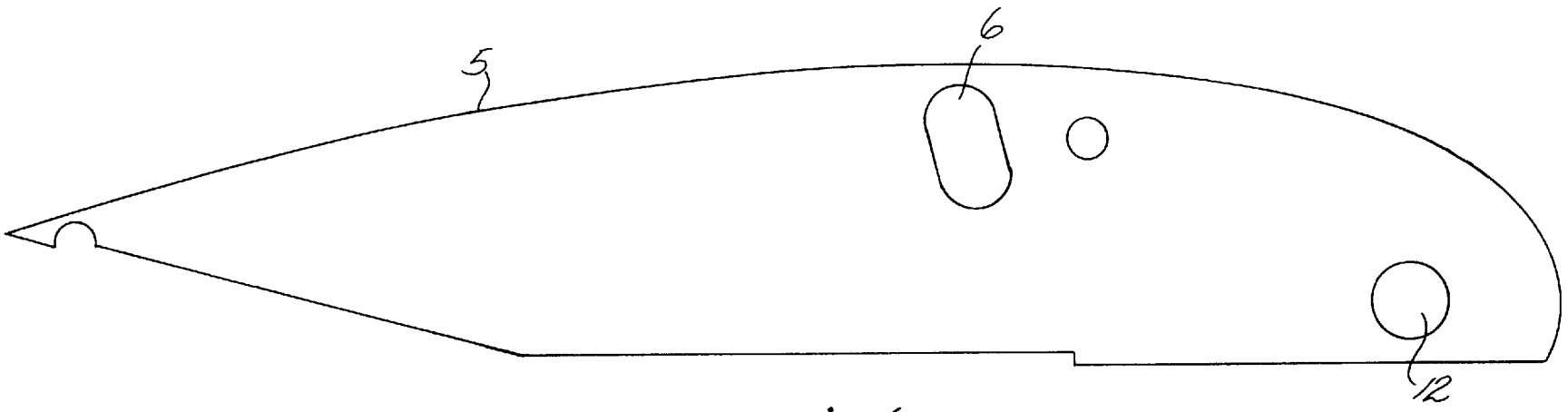
FIG. 6 is a side view of a dividing wall of the protective container of FIG. 1.
Figure 8:
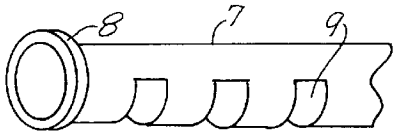
FIG. 8 is a perspective view of the magnetic rod of FIG. 7.

The storage device arrangement according to the invention in the embodiment of FIGS. 1 through 12 has a protective container 1, which consists of two side walls 2, 3 and a base 4 as well as six essentially identical dividing walls 5. FIG. 3 depicts side wall 2 and side wall 3 is essentially a mirror image of side wall 2. The side walls 2, 3 as well as the dividing walls 5 have a length which corresponds roughly to the length of the largest knife to be stored. In the crosswise direction, the heights of the walls have a somewhat larger dimension than the height of the knife blades.

Figure 7:
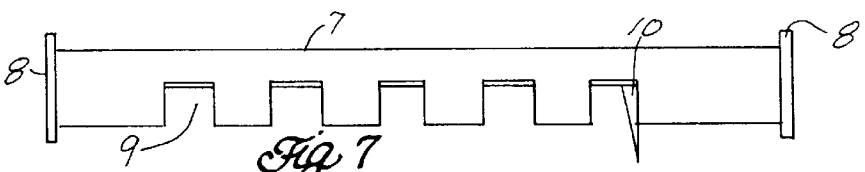
FIG. 7 is a side view of the magnetic rod of the protective container of FIG. 1.
Figure 12:
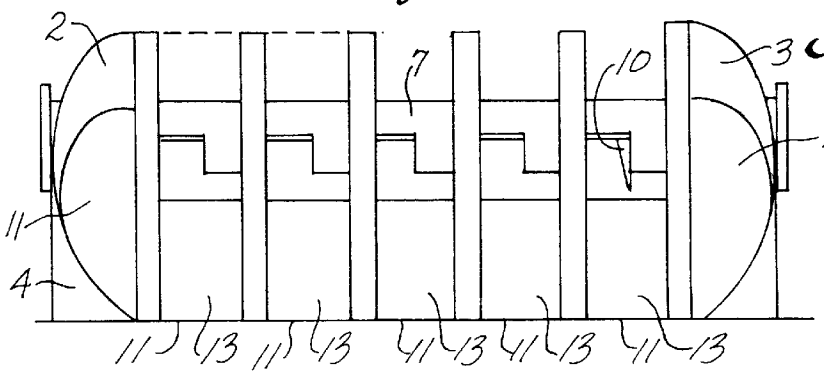
FIG. 12 is a back view of the protective container of FIG. 11.

The walls mentioned each have an elongated hole 6 to accommodate a magnetic rod 7. The magnetic rod is secured against lateral displacement out of the storage device after insertion in the protective container 1 by safety rings 8 positioned on its ends. The safety rings are applied at a distance from the side walls 2, 3, on the magnetic rod 7 so the rod is movable within the elongated holes 6. The magnetic rod 7 has recesses 9 along its length each to accommodate a different one of knife blades 10. Only one blade 10 is depicted in FIGS. 7 and 12 respectively for clarity.

The protective container further has pivotable support legs 11, which are disposed solidly on a shaft 11*a* which is pivotally mounted through the dividing walls 5 by holes 12. The supporting legs 11 have a section 13 to raise the knife handles 14 to an inclined position of the protective container 1. This inclined position represents the working position.

For the additional safety of the knives in the protective container, a removable rod-shaped safety element 16 is disposed in holes 15 through walls 2 and 3 above the knife blades and running at right angles thereto in the protective container. In the present embodiment a ceramic knife sharpener is provided as such a safety element.

Figure 9:
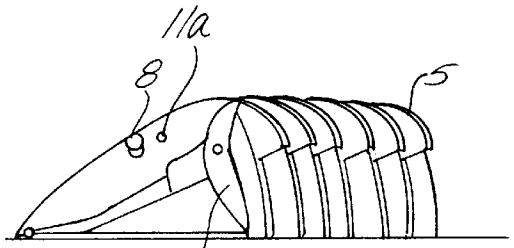
FIG. 9 is a perspective view of the protective container of FIG. 1 in a removal position.
Figure 11:
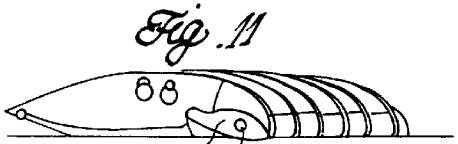
FIG. 11 is a perspective view of the protective container of FIG. 1 in a safe position.
Figure 10:
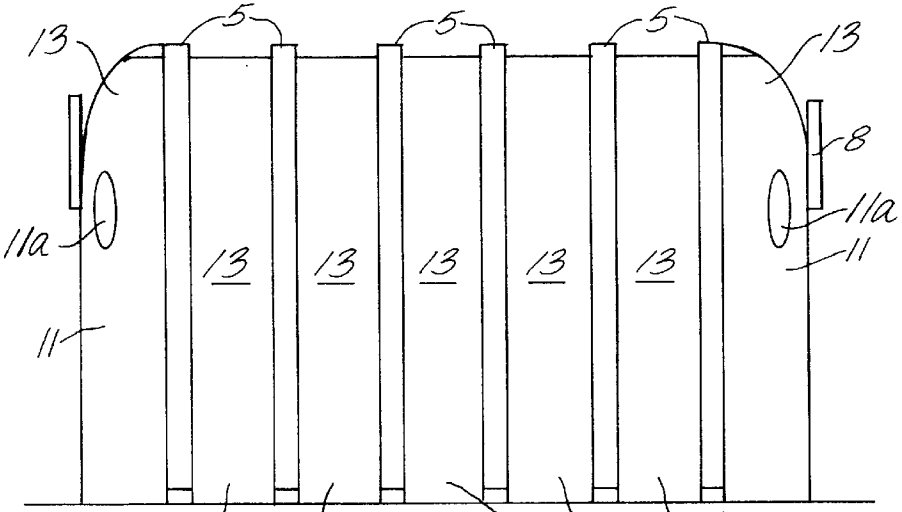
FIG. 10 is a back view of the protective container of FIG. 9.

The insertion of the knives in the protective container 1 occurs in the inclined position of the protective container depicted in FIG. 2, 9, and 10. The knives are inserted with their blades 10 in the protective container and each is placed in one of the recesses 9 in the magnetic rod 7. At this time, the magnetic rod is located in an upper position in the elongated holes 6 which may be seen in FIG. 2.

For the safe storage of the knives, the supporting legs 11 are pivoted approx. 90° into the position depicted in FIG. 1. Thus, the knife handles 14 and the magnetic rod 7 with the knife blades are lowered. The magnetic rod is now in the lower region of the elongated holes 6. The cutting edges of the knives are now directly on the base 4 and can no longer be touched.

In order to further secure the knives, the safety element 16 can be introduced into the protective container 1 in this position. Since the safety element runs above the knife blades crosswise through the protective container, pivoting of the knives by means of the sections 13 of the supporting legs 11 is not possible, i.e., the removal of the knives from their safe position is made increasingly difficult. The safety element thus represents, for example, additional child protection.

To prevent the slippage of the protective container in its inclined position on a support surface, the protective container has a rubber stop 17 on the end opposite the end with the supporting legs.

In another embodiment according to FIG. 13 through 16, the arrangement according to the invention has a protective container 1 in which the four pivotable storage containers 18, which are connected to each other, are provided. The storage containers 18 have insertion openings 19 in an insertion end for the insertion of the knives to be stored. The storage containers 18 pivot on a shaft 20. A lever 21 to pivot the storage containers 18 is also provided in the protective container 1. The lever 21 is seated on a shaft 22, on which supporting legs 23 are attached outside the protective container 1.

Figures 13, 14, 14A:
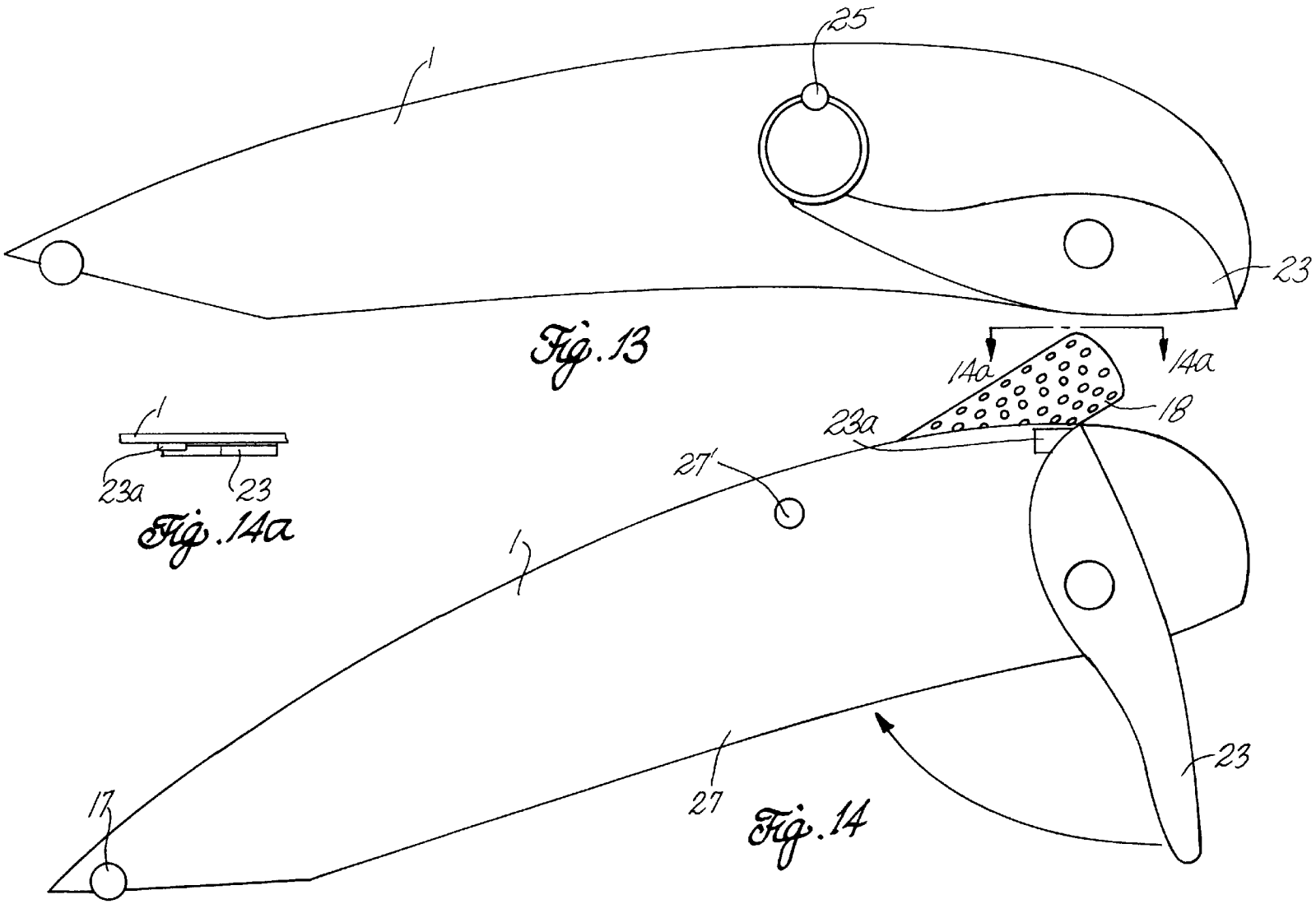
FIG. 13 is a side view of an alternative embodiment of protective container with a safe storage container.
FIG. 14 is a side view of the protective container of FIG. 13 in a removal position.
FIG. 14*a* is a partial top view of the protective container along line 14*a*—14*a* of FIG. 14 illustrating the cooperation between the stop element and the support leg.
Figure 15:
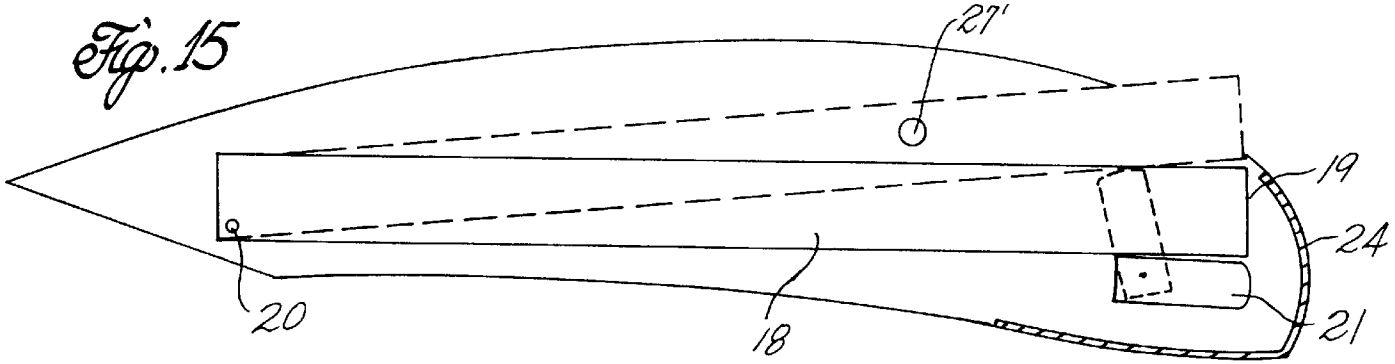
FIG. 15 is a longitudinal cross section view of the protective container of FIG. 13.
Figure 16:
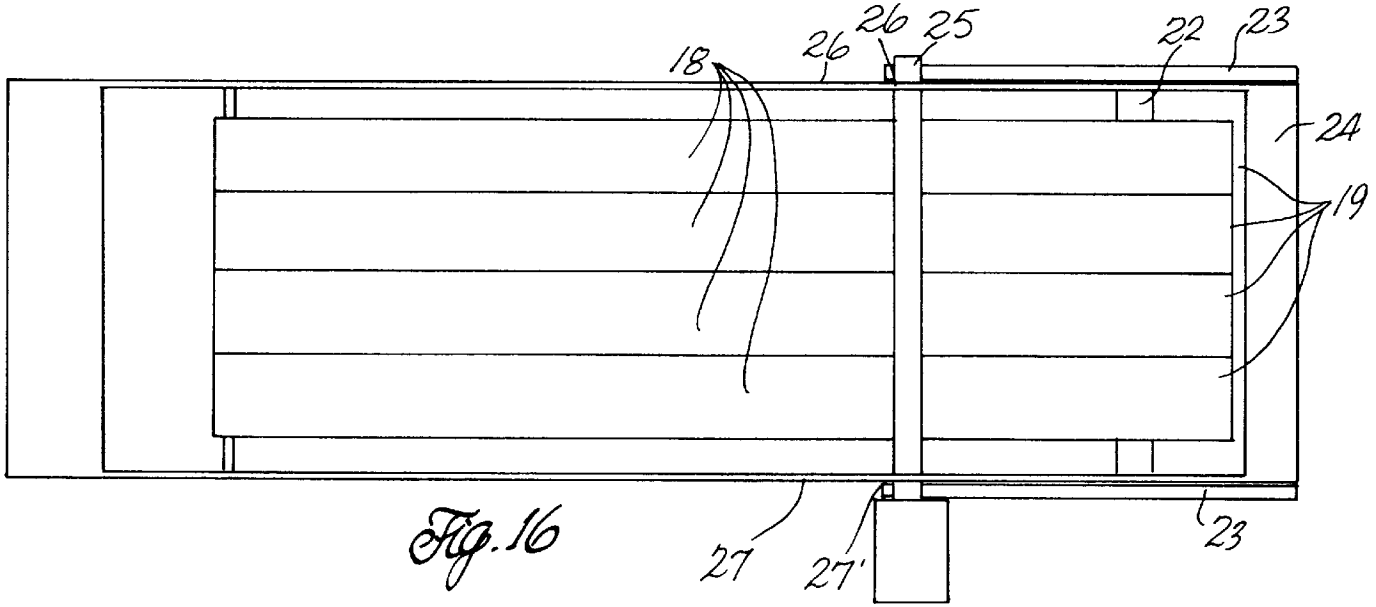
FIG. 16 is a top plan view of the protective container of FIG. 13.

In the safe position depicted in FIG. 13, 15, and 16, the storage containers 18 are inside the protective container 1. The knives in the storage containers cannot be removed in this position since the insertion openings 19 are covered by the front end 24 of the protective container 1. In this embodiment depicted, the knives, including their handles, are inside the storage containers. Alternatively, the insertion openings 19 do not have to be in the immediate vicinity of the front end, but can also be farther away, such that the handles are outside the storage containers. In this case, the openings of the storage containers have a cross-section such that the knives may be inserted only with the cutting edges facing downward. Even if the knives could somehow be pulled out in the safe position such that the cutting edges are outside the storage containers, the edges cannot be touched because the protective container is closed on the bottom in this region.

The storage containers are additionally secured in their position in the protective container 1 by a safety element in the form of a steel knife sharpener 25. This steel knife sharpener is mounted in openings 26', 27' in the side walls 26, 27 of the protective container.

Knives to be stored are inserted in the storage containers in a pivoted position of the storage containers 18, as is seen in FIGS. 14, 14*a* and in dashed lines in FIG. 15. This position is fixed by the lever 21, whereby the protective container simultaneously stands at an incline because of the extended supporting legs 23 which rests against stop element 23*a*. Legs 23 are rotated against stop element 23*a*. Stop element 23*a* is positioned on the outside of the protective container. In this position a second stop 17 positioned at the opposite end of the protective container, ensures a slip-free position of the protective container 1 with respect to the surface upon which the container is placed.

If the storage containers are to be brought into the position in which removal of the knives is not possible, the supporting legs 23 are pivoted toward the back, whereby at the same time the lever 21 is pivoted forward into a horizontal position. Then the storage containers 18 lie in the horizontal position seen in FIG. 13, in which the insertion openings 19 are covered by the front face 24. Next, the steel knife sharpener 25 is inserted as a safety element through the corresponding openings of the side walls 26, 27.

If the storage containers are to be brought out of this safe position into the removal position, the operational steps mentioned are performed in reverse order.

Figure 17:
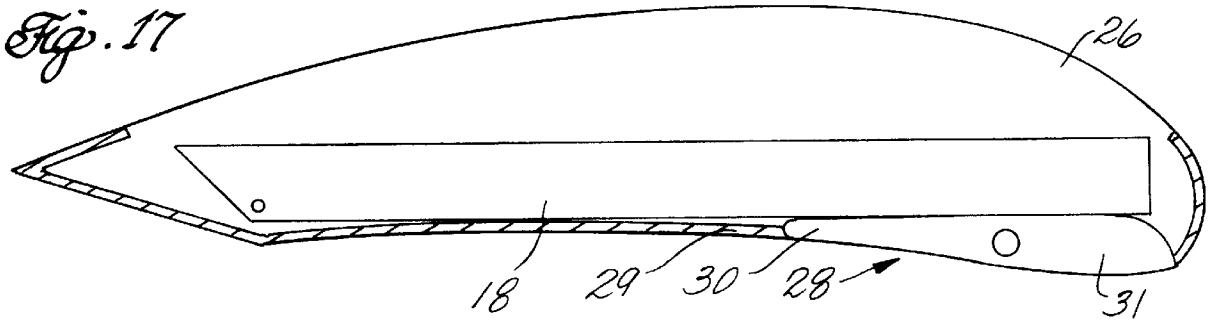
FIG. 17 is a longitudinal cross section view of an alternative embodiment protective container of FIG. 13 with levers to pivot the storage containers, which levers are also supporting legs, in a safety position.
Figure 18:
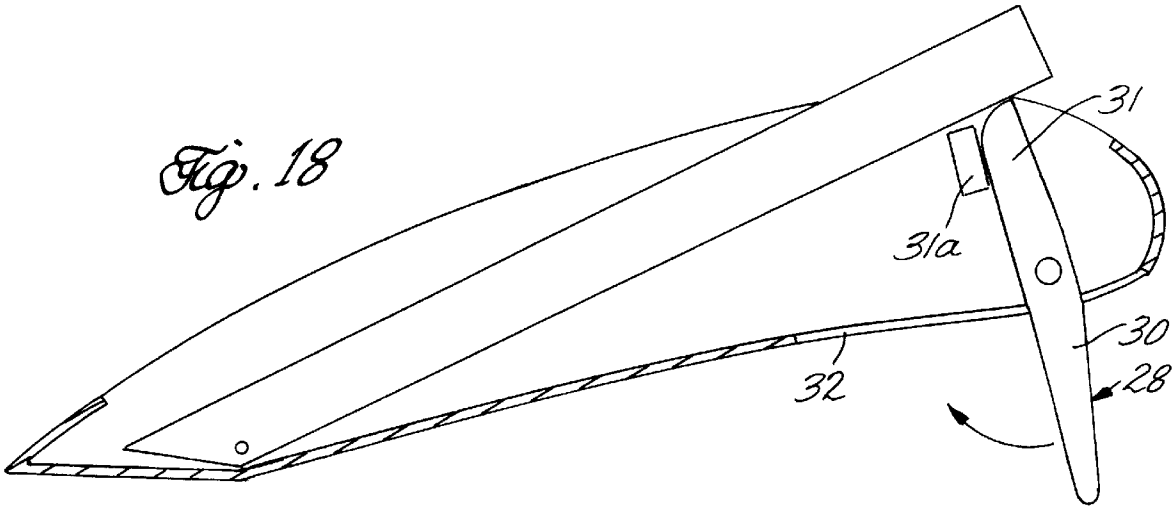
FIG. 18 is a longitudinal cross section view of the protective container of FIG. 17 in a removal position.

In the embodiment of FIG. 17 and 18, an alternative pivot mechanism is provided for the storage containers. Two supporting legs 28 are provided, which, in deviation from the preceding exemplary embodiment, are disposed inside the protective container rather than outside it. They are pivotally mounted in the region of a bottom 29 in the side walls 26, 27, whereby one arm 30 of the supporting leg 28 is used for the inclined position of the protective container 1, while the second arm 31 serves as a lever to raise the storage containers 18 out of the safe position into the removal position. The bottom 29 has in the region of the supporting legs 28 a recess 32 which enables their pivoting. The support legs 28 are pivoted counter-clockwise, to raise the storage containers to the inclined position, until second arm 31 rests against stop elements 31*a*. Stop elements 31*a* are rigidly secured to an inside surface of walls 26, 27.

Figures 19, 20:
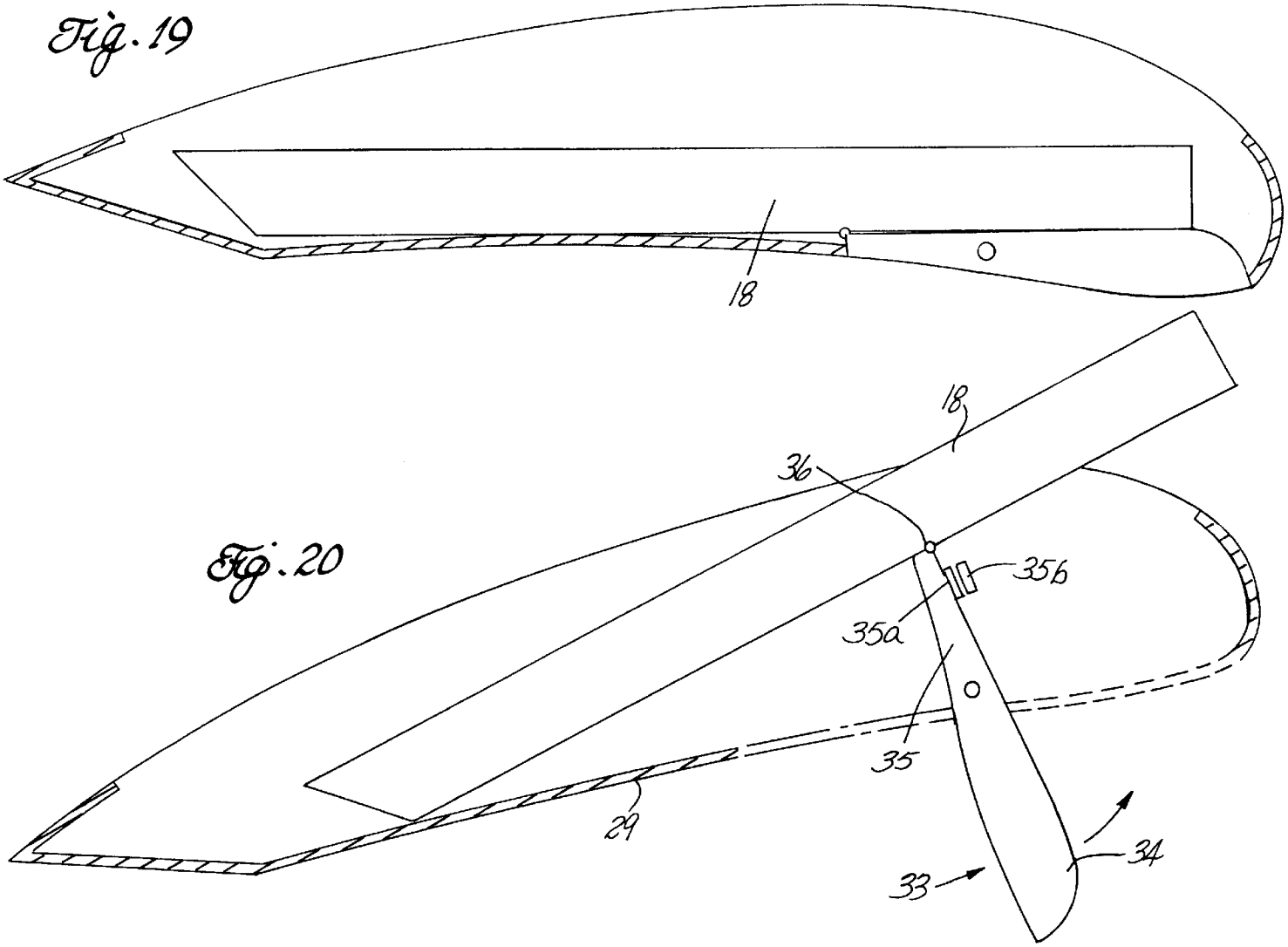
FIG. 19 is a longitudinal cross section view of a second alternative embodiment of the protective container of FIG. 13 with levers attached by joints to the storage containers.
FIG. 20 is a longitudinal cross section view of the protective container of FIG. 19 in a removal position.

In the embodiment of FIG. 19 and 20, an alternative type of pivoting of the storage containers from that of the previously described embodiments is provided. Whereas in the previous embodiments, the storage containers are only pivoted, in the embodiment of FIG. 19 and 20, their simultaneous shifting is provided. For this, pivotable supporting legs 33 are disposed inside the protective container 1, as in the embodiment of FIG. 17 and 18. These supporting legs 33 also have one arm 34 for the inclined position of the protective container 1 and one arm 35 to pivot the storage containers 18. The difference from the preceding embodiments consists in that the arm 35 does not rest loosely on the storage containers but is instead attached thereto by a joint 36 such as by a pin or pivot. This represents the only direct connection of the storage containers to the protective container 1. Upon pivoting of the supporting legs 33 counter-clockwise out of the position in FIG. 19 into the position depicted in FIG. 20, the storage containers are both pivoted and moved in the lengthwise direction. Arm 35 can be rigidly secured in the raised position by the pulling together of magnets 35*a* and 35*b*. Magnet 35*a* is positioned on arm 35 and magnet 35*b* is positioned on an inside surface of the outside walls of the protective container. Magnets 35*a* and 35*b* act as a stop for the working position of the protective container.

Figure 21:
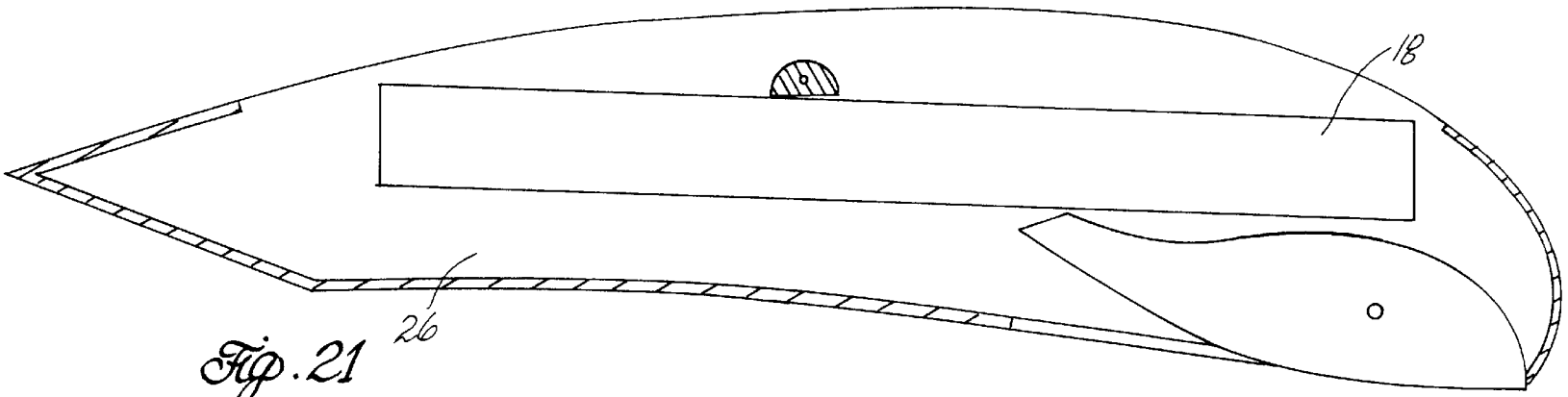
FIG. 21 is a longitudinal cross section view of a third alternative embodiment of the protective container of FIG. 13 with a magnetic rod for the attachment of storage containers.
Figure 22:
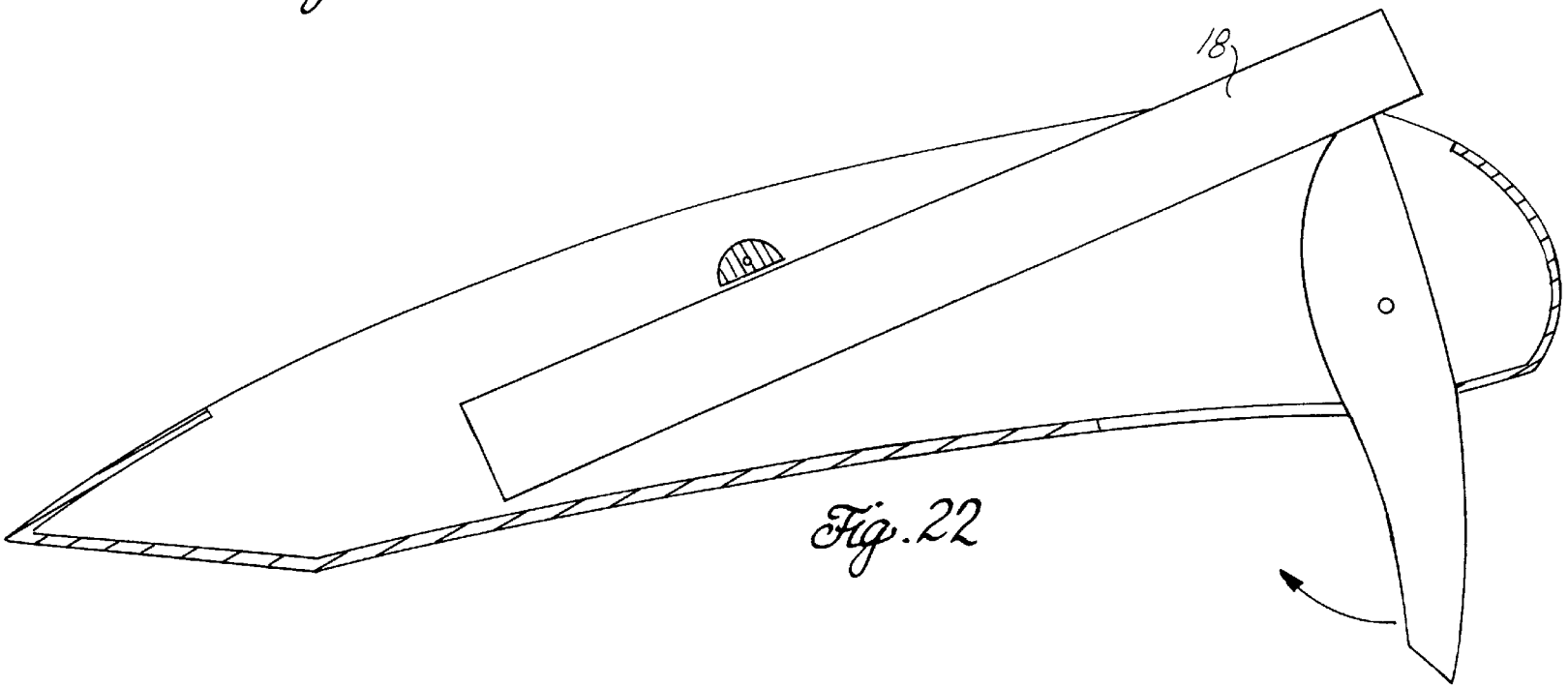
FIG. 22 is a longitudinal cross section view of the protective container of FIG. 21 in a removal position.

The embodiment of FIG. 21 and 22 discloses an additional possibility for the mounting of the storage containers 18. There, a pivotable rod-shaped magnet 37, extending perpendicular to the plane of the paper, which is mounted in the side walls 26, 27, of which only side wall 26 is shown, is disposed above the storage containers 18. The magnet has a semicircular cross-section, whereby the flat section of the semicircle rests on the storage containers. If the storage containers are not made of a ferromagnetic material, a ferromagnetic part (not shown) is provided on the storage containers in the region of the magnet. This embodiment has, compared to the previously described embodiments, the additional advantage that the storage containers can be taken out of the protective container. This may be advantageous, for example, for cleaning.

The disclosure of attached German patent application 295 12 707.4, filed on Jul. 25, 1995 is incorporated fully herein by reference. Priority of this German application is claimed.

Although the present invention has been described and illustrated with respect to five embodiments thereof, it is to be understood that it is not to be so limited, since changes and modifications may be made therein which are within the full intended scope of this invention as hereinafter claimed.

What is claimed is:

1. A storage device for cutlery having blades attached to handles, the storage device comprising a protective container having means positioned substantially entirely within the protective container for immobilizing the cutlery by engaging a blade portion of the cutlery within the protective container, the protective container and the immobilizing means being movable relative to each other from a position securing the cutlery and preventing the cutlery from being removed from the protective container to a working position allowing the cutlery to be removed from the protective container.

2. The storage device of claim 1 wherein the protective container has two side walls and a plurality of dividing walls attached to a base.

3. The storage device of claim 1 wherein the protective container further includes pivotable support legs for moving the protective container to the working position.

4. The storage device of claim 3 wherein the pivotable support legs are disposed below the handles of the cutlery stored in the protective container and include a portion to raise the handles to the working position.

5. The storage device of claim 1 wherein the immobilizing means is at least one separate storage container for the cutlery, the protective container and the storage container are movable relative to each other from a safe position in which the cutlery is not removable to a working position allowing the cutlery to be removed from the storage device.

6. The storage device of claim 5 wherein the storage container is pivotable relative to the protective container.

7. The storage device of claim 6 wherein the storage container is movable in a lengthwise direction relative to the protective container.

8. A storage device for cutlery having blades attached to handles, the storage device comprising a protective container having two side walls and a plurality of dividing walls attached to a base, the protective container having a magnetic rod disposed perpendicularly to an elongation of the blades substantially entirely within the protective container for immobilizing the cutlery, the magnetic rod includes recesses for receipt of the blades and is movably mounted through elongated holes in the walls of the protective container wherein the protective container and the magnetic rod are moveable relative to each other from a position securing the cutlery and preventing the cutlery from being removed from the protective container to a working position allowing the cutlery to be removed from the protective container.

9. The storage device of claim 8 wherein the elongated holes extend perpendicularly through the walls.

10. A storage device for cutlery having blades attached to handles, the storage device comprising a protective container having means position substantially entirely within the protective container for immobilizing the cutlery, the protective container and the immobilizing means being moveable relative to each other from a position securing the cutlery and preventing the cutlery from being removed from the protective container to a working position allowing the cutlery to be removed from the protective container, wherein the protective container includes at least one separate storage container for the cutlery, the storage container is pivotable and moveable in a lengthwise direction relative to the protective container from a safe position in which the cutlery is not removable to a working position allowing the cutlery to be removed from the storage device, and wherein there is an insertion end of the storage container having an insertion opening for the cutlery which is pivotable out of the protective container by at least one pivotable lever located in the protective container, and wherein the protective container includes an opening for the insertion end.

11. The storage device of claim 10 wherein the pivotable lever is positioned on a shaft, and wherein the shaft further attaches two pivotable support legs to the protective container whereby the support legs and the pivotable lever move the protective container to the working position.

12. The storage device of claim 10 comprising two pivotable levers forming support legs for the working position of the protective container.

13. The storage device of claim 12 wherein the pivotable levers lie loosely on the storage container.

14. The storage device of claim 13 wherein the storage container is pivotally attached to the protective container on an end opposite the insertion end.

15. The storage device of claim 12 wherein the pivotable levers are attached to the storage container by a pivotal joint.

16. The storage device of claim 15 wherein the pivotable support legs have stop elements, which along with stop elements on the protective container secure the protective container in the working position.

17. The storage device of claim 12 wherein the protective container includes stop elements which secure the protective container in the working position.

18. The storage device of claim 10 wherein a magnetic rod is mounted in the protective container perpendicularly to an elongated direction of the storage container.

19. The storage device of claim 1, wherein the storage device further comprises a removable rod-shaped safety element extending perpendicularly through the protective container adjacent the stored cutlery.

20. The storage device of claim 19 wherein the safety element is a steel knife sharpener.

* * * * *